US006591628B2

(12) United States Patent
Mochizuki et al.

(10) Patent No.: US 6,591,628 B2
(45) Date of Patent: Jul. 15, 2003

(54) OUTDOOR UNIT OF AIR CONDITIONER

(75) Inventors: Shigeo Mochizuki, Ihara-Gun (JP); Yasunori Ichikawa, Fuji (JP); Tomio Tanaka, Numazu (JP); Akihiro Suzuki, Fuji (JP); Toshihiro Yamamoto, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 09/936,743

(22) PCT Filed: Jan. 11, 2001

(86) PCT No.: PCT/JP01/00086

§ 371 (c)(1),
(2), (4) Date: Sep. 14, 2001

(87) PCT Pub. No.: WO01/51859

PCT Pub. Date: Jul. 19, 2001

(65) Prior Publication Data

US 2002/0134099 A1 Sep. 26, 2002

(30) Foreign Application Priority Data

Jan. 14, 2000 (JP) ..... 2000-6899
Jan. 14, 2000 (JP) ..... 2000-6900

(51) Int. Cl.[7] ..... F25D 21/14; F25B 39/04

(52) U.S. Cl. ..... 62/288; 62/259.1; 62/291; 62/507

(58) Field of Search ..... 62/288, 291, 298, 62/125, 259.1, 304, 507, 314; 165/47, 48.1

(56) References Cited

U.S. PATENT DOCUMENTS 3,759,321 A 9/1973 Ares
5,619,863 A * 4/1997 Kil ..... 62/428

FOREIGN PATENT DOCUMENTS

| | | |
|---|---|---|
| EP | 0 922 911 | 6/1999 |
| JP | 62-41144 | 10/1987 |
| JP | 4-254127 | 9/1992 |
| JP | 5-322223 | 12/1993 |
| JP | 8-145411 | 6/1996 |
| JP | 10-220883 | 8/1998 |
| JP | 11-23014 | 1/1999 |
| JP | 11-193941 | 7/1999 |
| JP | 11-280472 | 10/1999 |
| JP | 11-281097 | 10/1999 |
| JP | 11281195 A * | 10/1999 |
| JP | 11-281200 | 10/1999 |

* cited by examiner

*Primary Examiner*—Chen Wen Jiang
(74) *Attorney, Agent, or Firm*—Pillsbury Winthrop LLP

(57) ABSTRACT

An outdoor unit (1) of an air conditioner comprises a unit case having a rectangular shape in section and composed of side panels (4, 4, - -) in which a machine chamber (3) and a heat exchanger chamber (2) are defined so as to be vertically aligned in an installed state with the heat exchanger chamber being disposed above the machine chamber and being sectioned therefrom by means of a partition plate (12) which also acts as a drain plate or pan, and the side panels surrounding the heat exchanger chamber is formed with air suction ports (**4*a*, 4*a* - -). The outdoor unit (1) further comprises a heat exchanger unit (17, 18) having four side wall sections at least opposing two of which are inclined inward by a predetermined angle with respect to inner surfaces of the side panels to which the air suction ports are formed. Thus, the outside air can be effectively and smoothly introduced inside the outdoor unit. The outdoor unit is also provided with a duct unit (20) arranged in the unit case in association with the drain pan (12) for effectively discharging drain, cooling electrical part such as heat sink (22**) and improving the outer appearance of the outdoor unit.

11 Claims, 8 Drawing Sheets

OUTDOOR UNIT OF AIR CONDITIONER

This application is the National Phase of International Application PCT/JP01/00086 filed Jan. 11, 2001 which designated the U.S. and that International Application

TECHNICAL FIELD OF THE INVENTION

The present invention relates to an outdoor unit installed an outdoor side of a body of an air conditioner, and more particularly, to an outdoor unit of an air conditioner especially of a heat-pump type for the purpose of increasing the degree of freedom for the outdoor location thereof, providing an improved drain discharge structure and an improved cooling structure of an electrical part such as heat sink.

BACKGROUND ART

Conventionally, an example of an outdoor unit of an air conditioner of the type mentioned above is disclosed in Japanese Utility Model No. SHO 62-41144. This outdoor unit of the air conditioner is divided into vertically two parts, by, for example, a partition plate, comprising a machine chamber or room in which a compressor, an accumulator, an electrical equipment box and so on are arranged and a heat exchanger chamber into which a heat exchanger unit composed of V-shaped heat exchanging element, an outdoor fan and so on are arranged. These chambers are housed in a unit casing in which the heat exchanger chamber is disposed above the machine chamber.

The outdoor unit of the air conditioner is formed with a ventilation port or opening having a right-angled triangular shape at its outer wall section surrounding the V-shaped heat exchanging element of the heat exchanger unit. Atmospheric air is introduced through this ventilation port, is subjected to a heat exchanging with the V-shaped heat exchanging element, and then, is discharged outside through an air blowout port or opening formed to an upper portion thereof.

In such outdoor unit of the air conditioner of the structure mentioned above, however, in a case where a plurality of such outdoor units are installed in parallel and close to each other in a horizontal direction, the air suction ports of the adjacent outdoor units are opposed close to each other. Thus, an amount of air to be induced into the heat exchanger units through the triangular ventilation ports will be decreased, and accordingly, the heat exchanging function can be sufficiently performed with the V-shaped heat exchanging element. Hence, the heat exchanging capacity is lowered and the air conditioning function is also lowered. In addition, in a case where such outdoor unit is installed so that the suction port of the heat exchanger unit is arranged to be close to the wall surface, such as an exterior wall of a building, there decreases the introduction flow rate of the atmospheric air through the suction port opposing close to the wall surface. Thus, the heat exchanging function by means of the heat exchanging element is lowered. That is, there provides a problem that the heat exchanging capability and air conditioning capability or function may be lowered depending on the installation site or installation method thereof.

Furthermore, in usual, in a conventional structure of the outdoor unit of the air conditioner, after a warming (heating) operation mode of the air conditioner has been switched to a defrosting operation mode, a drain caused during this operation mode is collected by a drain plate and then discharged outside the outdoor unit through a drain hose, for example. However, in the conventional structure, such drain hose is extends outside thereof, providing no good outer appearance and damaging effective use of installation space.

Still furthermore, in a conventional structure, a heat sink as an electrical part is exposed in the machine chamber, and the cooling of the electrical parts or elements is performed through a natural heat radiation or by an air sucked through a gap between an outdoor fan and a partition plate sectioning the machine room and the heat exchanger chamber. Thus, the cooling of the electrical elements and the like is not adequately made.

Therefore, a primary object of the present invention is to substantially eliminate defects or drawbacks encountered in the prior art mentioned above and to provide an outdoor unit of an air conditioner capable of being installed while maintaining a high heat exchanging function without being lowered irrespective of any installation site and installation method and capable of increasing the degree of freedom for its installation to thereby efficiently utilize the installation space.

Another object of the present invention is to provide an outdoor unit of an air conditioner capable of improving an outer appearance of the outdoor unit thereof and effectively cooling electrical parts or elements housed therein.

DISCLOSURE OF THE INVENTION

These and other objects can be achieved according to the present invention by providing, in one aspect, an outdoor unit of an air conditioner, comprising:

- a unit case having a rectangular shape in section and composed of side panels in which a machine chamber and a heat exchanger chamber are defined so as to be vertically aligned in an installed state, the heat exchanger chamber being disposed above the machine chamber and separated by means of a partition plate, the side panels surrounding the heat exchanger chamber being formed with suction ports; and
- a heat exchanger unit disposed inside the heat exchanger chamber and having four side wall sections at least opposing two of which are inclined inward by a predetermined angle with respect to inner surfaces of the side panels, of the unit case to which the air suction ports are formed.

In a preferred embodiment, at least two side wall sections of the heat exchanger unit are arranged in substantially parallel to each other.

The heat exchanger unit comprises a pair of heat exchangers each having an L-shape in a plan view providing an obtuse angle so that the respective sides of the L-shaped heat exchangers are arranged to be opposed to the air suction ports, respectively, and to provide substantially a parallelogram shape in a plan view.

An electrical element or like is arranged in the machine chamber. The partition plate vertically sectioning the heat exchanger chamber and the machine chamber has a dish-shape acting as drain pan to which a drain duct is formed.

As described above, according to the present invention, a pair of opposite sides of the heat exchanger housed in the heat exchanger chamber are inclined at a predetermined angle inward with respect to the inner surface of the periphery wall of the heat exchange chamber formed with the air suction ports. Moreover, a suction space in the clearance between the outer periphery wall of the heat exchanger chamber and each of the opposite sides of the heat exchanger is widened by the inclination of the opposite side portions of the heat exchanger, and thus, a decrease in the atmospheric air suction area for each heat exchanger can be suppressed and prevented. Thus, the lowering of the heat exchanging capability of the heat exchanger can be suppressed and prevented.

In addition, even in the case where a plurality of outdoor units are arranged in parallel to each other, each of the opposite sides of the heat exchanger is inclined so that the air suction space of the clearance can be ensured.

Therefore, even if the outdoor unit is installed while one surface of the heat exchanger chamber is opposed close to the exterior wall of the building or the like, this outdoor unit can be installed while maintaining its high heat exchanging capability and function.

Therefore, the degree of freedom for installation of the outdoor unit is increased and the installation space thereof can be efficiently utilized.

In another aspect of the present invention, there is provided an outdoor unit of an air conditioner, comprising:

a unit case having a rectangular shape in section and composed of side panels in which a machine chamber and a heat exchanger chamber are defined so that the heat exchanger chamber is disposed above the machine chamber vertically in an installed state, the side panels being formed with air suction ports to portions of the side panels surrounding the heat exchanger chamber;

a heat exchanger unit having four side wall sections opposing to inner surfaces of the side panels to which the air suction ports are formed;

an electrical element disposed on a bottom plate of the machine chamber; and a drain pan formed as a partition plate vertically sectioning the heat exchanger chamber and the machine chamber; and a duct unit having upper and lower openings opened to an upper surface of the drain pan and opened to a lower surface of the bottom plate of the machine chamber.

In a preferred embodiment of this aspect, the upper opening of the duct unit is divided into a plurality of ports by a partition wall so that one opening port is in a level substantially the same as the upper surface of the drain pan and another opening port is in a level higher than the upper surface thereof.

The electrical element is disposed in the machine chamber at a front side portion of the unit case facing outside thereof, and the electrical element includes a heat sink. The duct unit is provided with an air passage communicated with the other opening port disposed in the level higher than the upper surface of the drain pan and said air passage is formed with an opening through which the heat sink is exposed.

The partition wall has a lower end portion ended at a portion upper than the lower end opening of the duct unit.

The heat exchanger unit has four side wall sections at least opposing two of which are inclined inward by a predetermined angle with respect to inner surfaces of the side panels to which the air suction ports are formed.

According to this aspect of the present invention, the drain produced during the operation of the air conditioner is received and collected by the drain pan in shape of plate and is then discharged downward the bottom plate of the machine chamber through the duct unit having the improved structure, which is arranged inside the outdoor unit, thus improving the outer appearance of the outdoor unit.

Furthermore, although no drain is produced at the outdoor heat exchanger during the cooling operation mode of the air conditioner, the air in a space below the bottom plate of the machine chamber is sucked into the heat exchanger chamber, and the inside of the duct unit is ventilated. An opening through which an electrical element of heat sink is exposed at the midway of the axial direction of the duct unit, and therefore, the heat sink can be well cooled by the ventilation of this duct unit.

BRIEF DESCRIPTION OF THE DRAWINGS

In the accompanying drawings:

FIG. 4 is an illustration of the outdoor unit shown in FIG. 3, which is installed close to a wall surface of an external wall of a building or like;

BEST MODE FOR EMBODYING THE INVENTION

Figure 1:
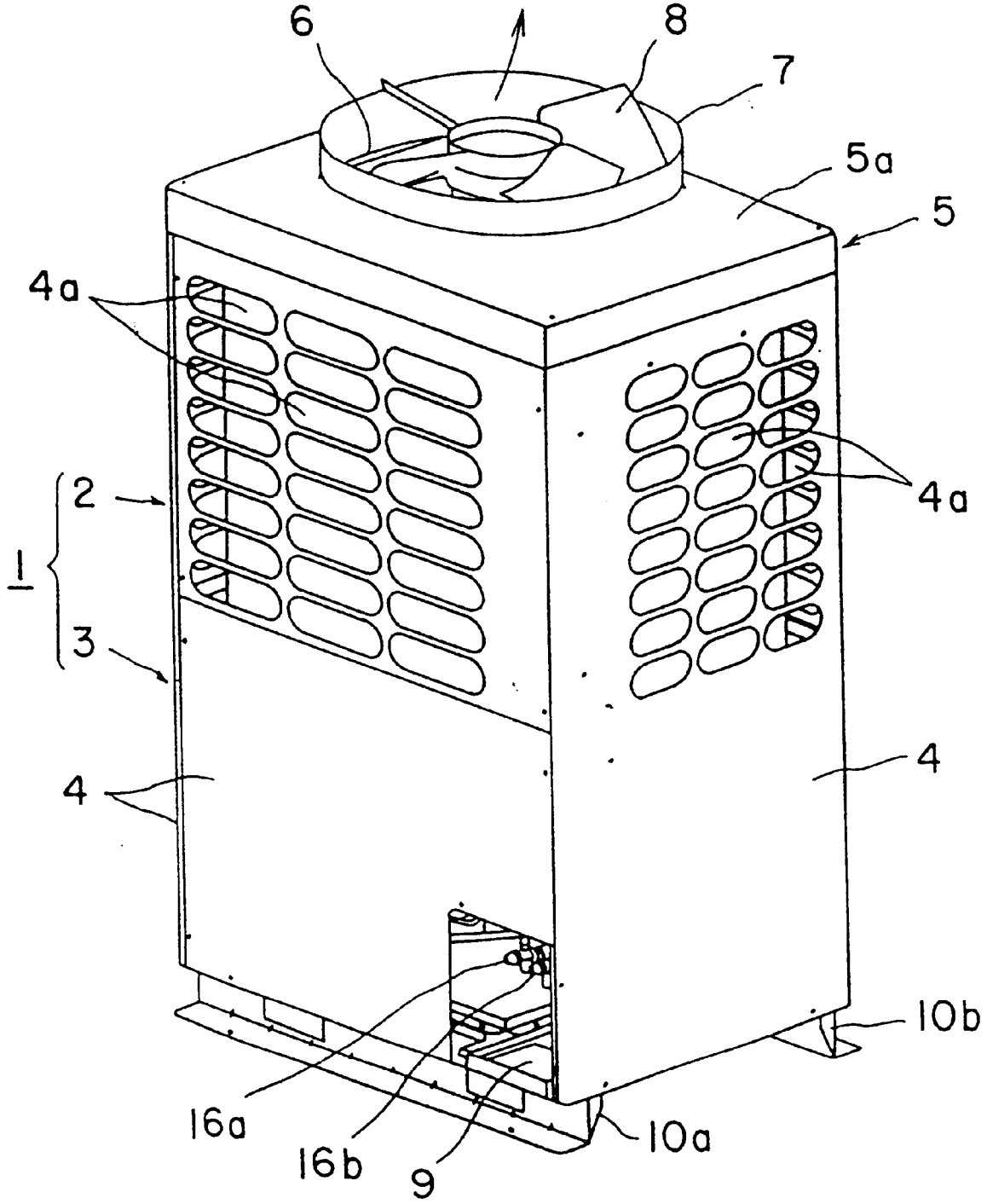
FIG. 1 is a perspective view showing an outdoor unit of an air conditioner according to one embodiment of the present invention.

A first embodiment of an outdoor unit of an air conditioner according to the present invention will be described hereunder with reference to FIGS. 1 to 4, in which like reference numerals are added to the same or identical portions or elements and in which FIGS. 3 and 4 may be used commonly to an embodiment of FIGS. 5 to 8, which will be referred to hereinlater.

Figure 2:
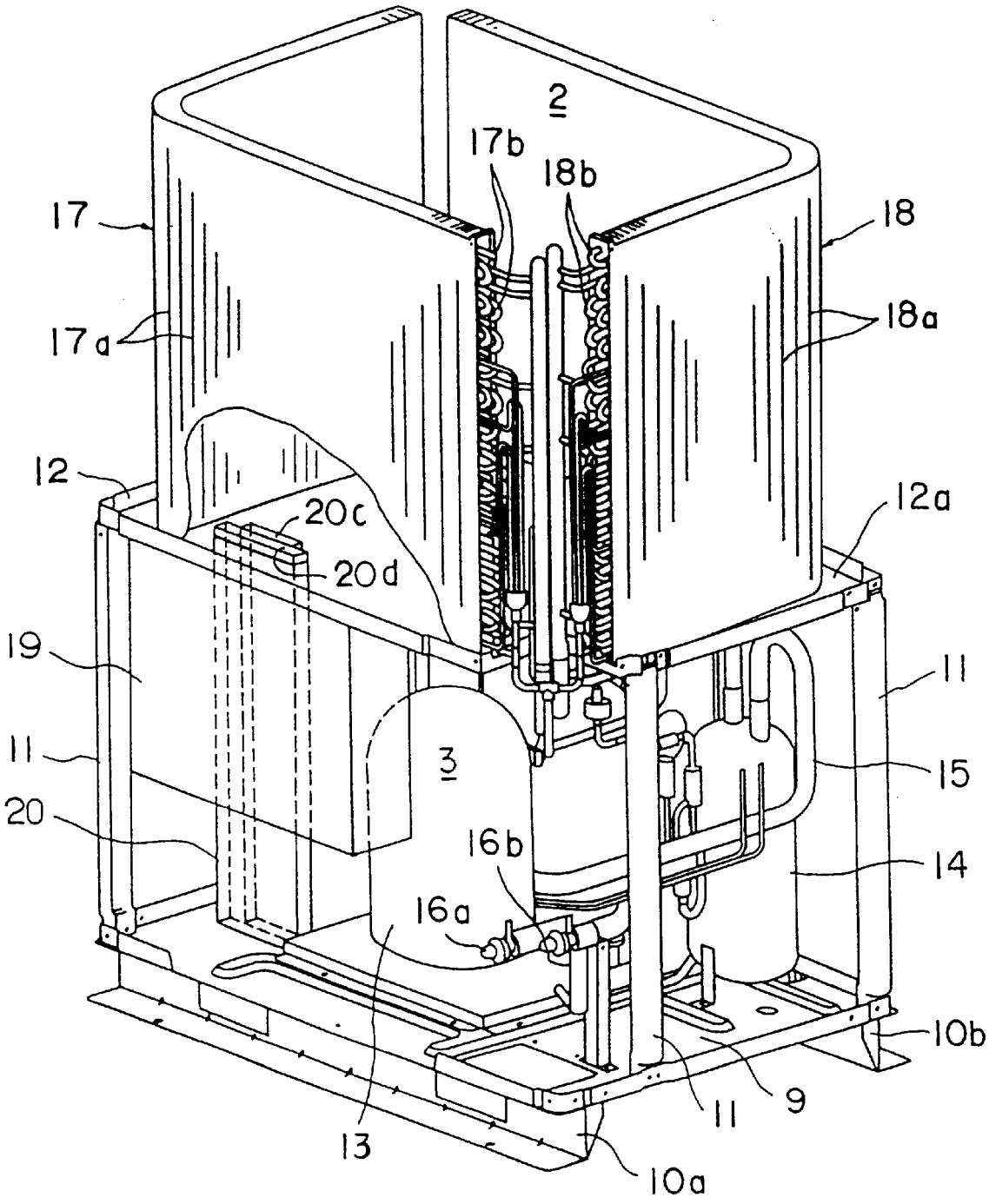
FIG. 2 is a perspective view of the outdoor unit of the air conditioner shown in FIG. 1, in which an outer casing is removed to show an inside of the outdoor unit.

With reference to FIGS. 1 and 2, an outdoor unit 1 of an air conditioner comprises a heat exchanger chamber 2 and a machine chamber or room 3. The heat exchanger chamber 2 and the machine chamber 3 are vertically arranged in an installed state such that the heat exchanger chamber is disposed above the machine chamber and both chambers are surrounded by a plurality of side panels 4, 4, - - forming an outer peripheral wall (section) of the outdoor unit 1. The upper surface of the outdoor unit 1 has a rectangular flat shape, and as shown in FIG. 2, the upper portion of the heat exchanger chamber 2 is opened, which is closed, as shown in FIG. 1, by a top plate 5 as an upper lid (cover) member, thus constituting a unit case or casing of the outdoor unit 1 having a rectangular shape in section.

A circular air blowout port or opening 6 is formed at substantially a central portion of a cover section 5*a* of a top plate 5, i.e. upper central portion of the heat exchange chamber 2, and a cylindrical fan casing 7 is formed concentrically and integrally or like manner so as to protrude at the air blowout port 6. An outdoor fan 8 is arranged concentrically in this fan casing 7.

As shown in FIG. 2, the machine chamber 3 is defined by a bottom plate 9 formed of a relatively thick steel plate and an upper partition plate 12 sectioning the heat exchanger chamber 2 and the machine chamber 3 in a vertical alignment. The partition plate 12 is supported by and fixed to a plurality of columns 11, 11, 11, 11 formed of, for example, L-angle steels, standing from four corner portions of the bottom plate 9. A pair of L-shaped mounting legs 10*a* and 10*b* are integrally provided at both left and right side ends of the bottom plate 9, and the outdoor unit 1 is supported by the mounting legs 10*a*, 10*b* when installed on a ground or like. The partition plate 12 has a dish shape, and hence, is utilized as a drain pan for collecting and discharging liquid (water) drain as mentioned detail hereinlater.

On the bottom plate 9 of the machine chamber 3, there are arranged a compressor 13, an accumulator 14 and the like, and pipes or ducts 15 connecting these members. A pair of pipe connection valves 16*a* and 16*b* connected to an indoor unit, not shown, electrical parts or element box 19, a rectangular cylindrical duct 20 are also arranged.

As shown in FIG. 2, the electrical part box 19 has a box-shaped (horizontally rectangular) structure in which an inverter, not shown, for controlling revolution of the compressor 13 and electrical elements or parts are accommodated. The upper end of this box-shaped structure is fixed to the lower bottom surface of the partition plate 12.

Figure 3:
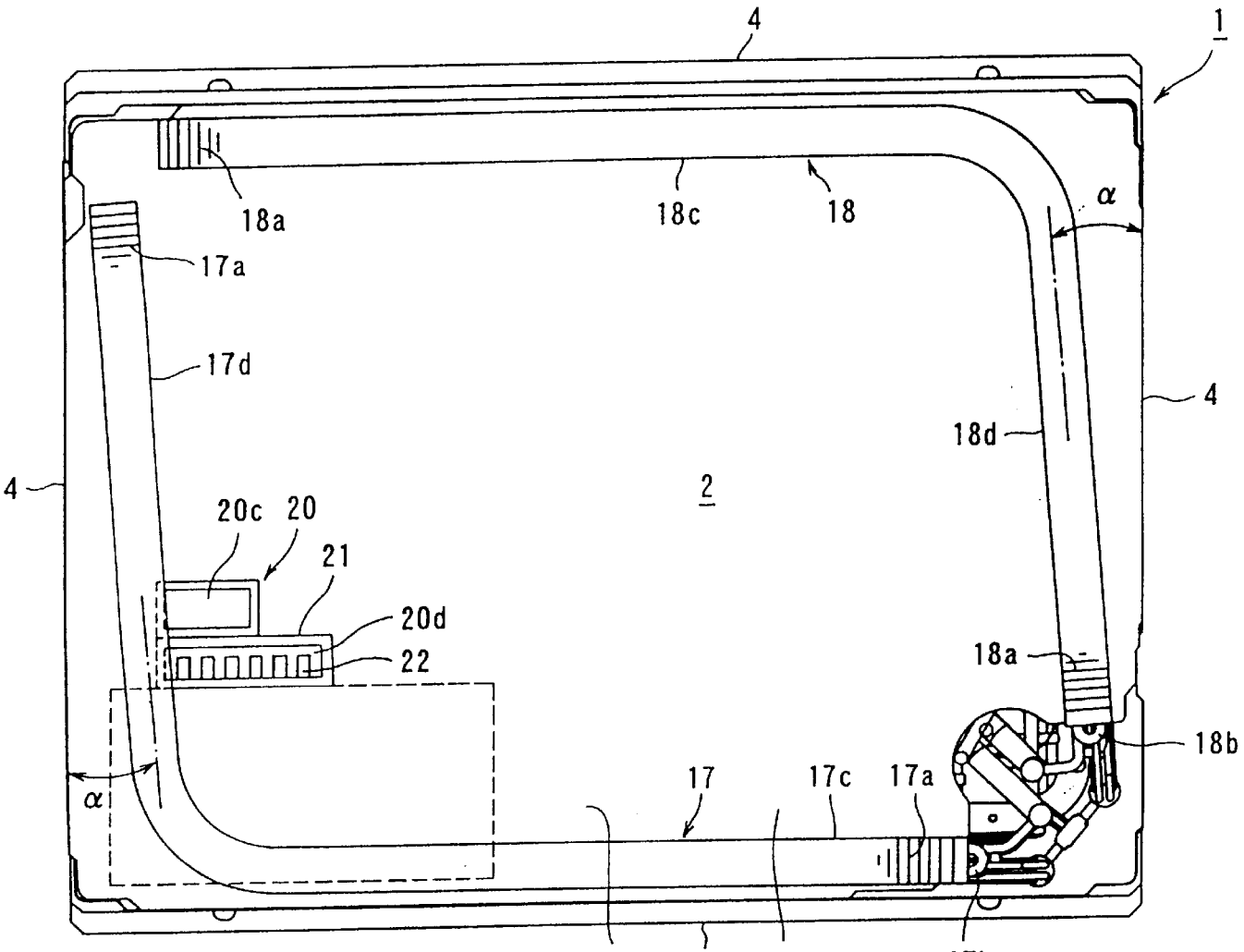
FIG. 3 is an illustrative plan view of the heat exchanger chamber of the outdoor unit of the air conditioner.

As shown in FIG. 3, a pair of left and right heat exchangers 17 and 18 formed respectively, each at an obtuse angle in L-shape in a plan view viewed from an upper side, are disposed in a standing state on a rectangular partition plate 12.

The heat exchangers 17 and 18 respectively comprise: a number of fins 17*a* and 18*a* made of longitudinally rectangular thin plates arranged in predetermined pitches; a number of heat exchanger tubes, not shown, arranged in parallel to each other over a plurality of stages in a vertical direction from the upper end to the lower end of these fins 17*a* and 18*a* so that the heat exchange tubes penetrate the fins 17*a* and 18*a* in the plate thickness direction; and a plurality of U-shaped bents 17*b* and 18*b* for coupling the adjacent elements of the heat exchanger tubes at the outer end portions thereof in the vertical direction, and the bents 17*b* and 18*b* form one bellows tube shaped coolant flow passage in the connected arrangement, respectively. The coolant flow passages of these heat exchangers 17 and 18 are connected in series or in parallel.

These heat exchangers 17 and 18 are also provided with horizontal sections 17*c* and 18*c* extending in a horizontal direction at the upper and lower portions shown in FIG. 3 and opposite sections 17*d* and 18*d* bent at an obtuse angle in substantially an L-shape from one end of each of these horizontal sections 17*c* and 18*c* and opposite to each other in the transverse direction shown in FIG. 3.

As shown in FIG. 3, the opposite sections 17*d* and 18*d* are bent at an obtuse angle in an L-shape, so that these sections are inclined inwardly at a predetermined angle a with respect to the surfaces of the side panels 4 opposed at the outward portions thereof. Each of the side panels 4, is formed, as shown in FIG. 1, with a plurality of air suction ports or openings 4*a*, 4*a* which are punched so as to penetrate at the upper portions of the opposite sections 17*d* and 18*d*.

In addition, a plurality of air suction ports or openings 4*a*, 4*a* . . . are also punched at the upper opposite portions of each of the side panels 4, 4 - - opposing, respectively, to each of the horizontal sections 17*c* and 18*c* of the heat exchangers 17 and 18. The inside and outside of the heat exchange chamber 2 are communicated with each other through these air suction ports 4*a*, 4*a* - - .

Furthermore, a rectangular drain discharge port or opening 20*c*, for example, is punched at one corner of the inner bottom surface of the partition plate 12, which is inclined so as to collect and discharge the drain through the drain discharge port 20*c*. In addition, a square-cylindrical drain discharge duct 20 is securely fixed to the lower end portion of the discharge port 20*c* with water tightness. The lower end portion of this drain discharge duct 20 is suspended downward in the vertical direction so as to penetrate the bottom plate 9 of the machine chamber 3 substantially vertical to the plate thickness direction to discharge the drain in the downward direction. The arrangement of the duct 20 will be described more in detail hereinlater with reference to FIGS. 6 to 8.

As shown in FIG. 3, a pair of heat exchangers 17 and 18 are arranged to have the horizontal sections 17*c* and 18*c* opposed to each other in the vertical direction shown in FIG. 3 and arranged in substantially parallel so as to provide the opposite sections 17*d* and 18*d* opposed to each other in the transverse direction, and the heat exchangers 17 and 18 are arranged substantially in parallel to each other so as to provide substantially a parallelogram shape. Therefore, the outer surface area of a pair of these heat exchangers 17 and 18, that is, a heat exchanging area, can be increased more than that of a rectangular heat exchanger, for example having no such inclined portion.

Figure 4:
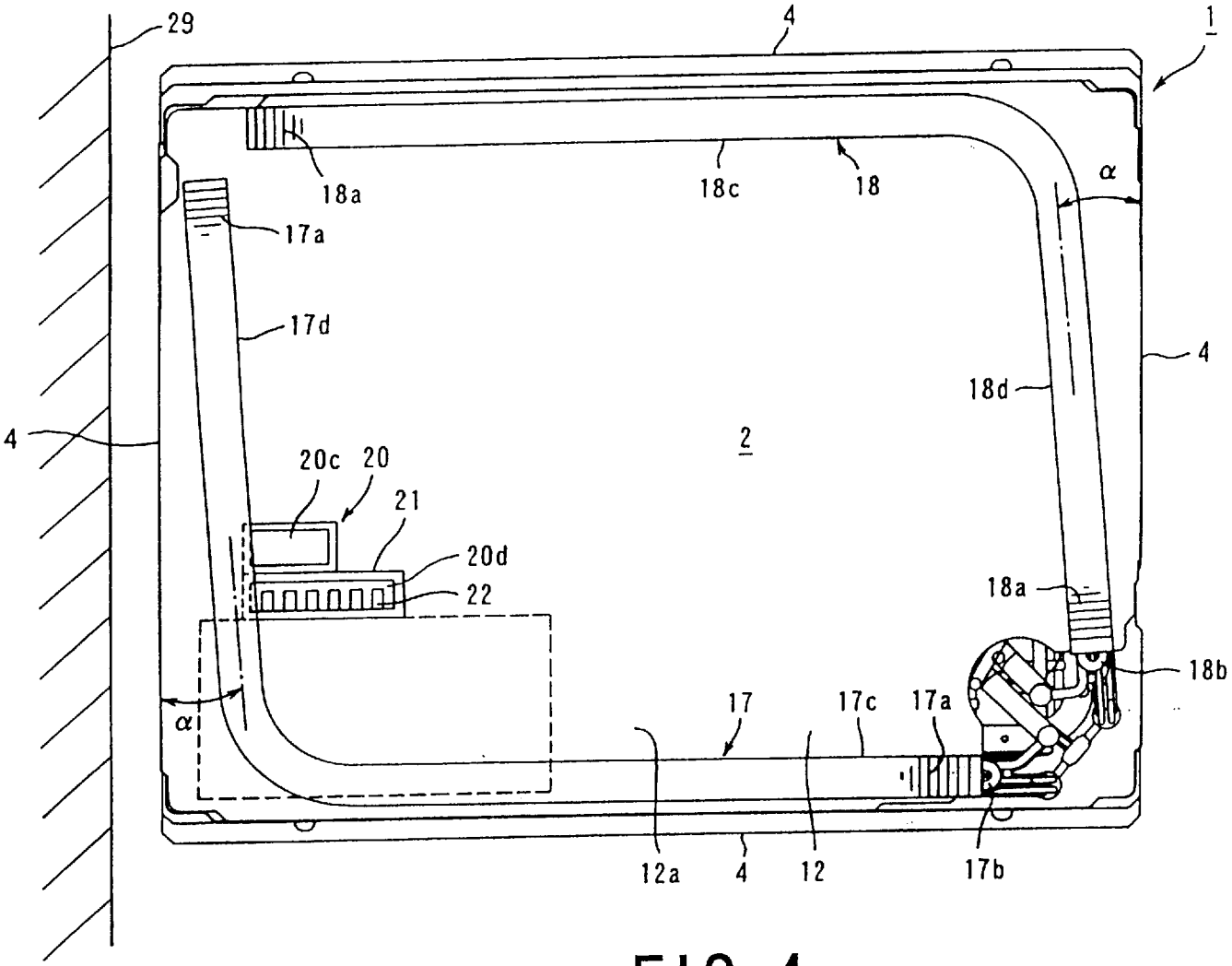

FIG. 4 shows an illustrated flat plan view partially broken of the outdoor unit in a manner that the outdoor unit 1 is disposed and installed at a position where the outer surface of one side plate panel 4 is close to a wall surface 29 of the exterior wall of a building or the like.

In this case, this one side plate panel 4 is opposed to be close to the wall surface 29, and a plurality of air suction ports 4*a*, 4*a* are formed to this side plate panel 4 so as to closely oppose to the wall surface 29, so that a clearance between these air suction ports 4*a* and the wall surface 29 becomes small. However, the opposite side 17*d* of one heat exchanger 17 opposed to the wall surface 29 has an inward inclination by a predetermined angle $\alpha$ with respect to the wall surface 29 and the side panel 4, and its inclined outer surface is opposed to the side panel 4 opposing close to the wall surface 29 and the suction port 4*a* on both the surfaces of the adjacent side panel 4 (lower surface side panel 4 in FIG. 3). Moreover, a suction space of the clearance between the inner surface of the side panel 4 and the opposite side 17*d* of the heat exchanger 17 is expanded by inclining the opposite side 17*d*, and thus, a decrease in the air suction area for the heat exchanger 17 can be suppressed. Therefore, the air can be adequately sucked from a plurality of suction ports 4*a* of the side panel 4 on both the left side surface and the lower side surface in FIG. 3 into the heat exchanger chamber 2 and can be heat-exchanged sufficiently. Thus, the reduction of the heat exchanging ability can be suppressed.

Therefore, as shown in FIG. 4, the outdoor unit 1 can be installed with the high heat exchanging ability being maintained at a position which is deemed as a dead space in the conventional arrangement and at which the outer surface of one side ate panel 4 is close to the wall surface 29 such as the exterior wall of the building. Namely, the outdoor unit 1 of the air conditioner can be installed efficiently in such dead space. Even in the case where the outdoor unit 1 is disposed close to the wall surface 29 of a building, for example, so as to exchange the left and right side panels 4, 4 with each other such as shown in FIG. 4, of course, substantially the same function and effect as those mentioned above can be attained.

Figure 5:
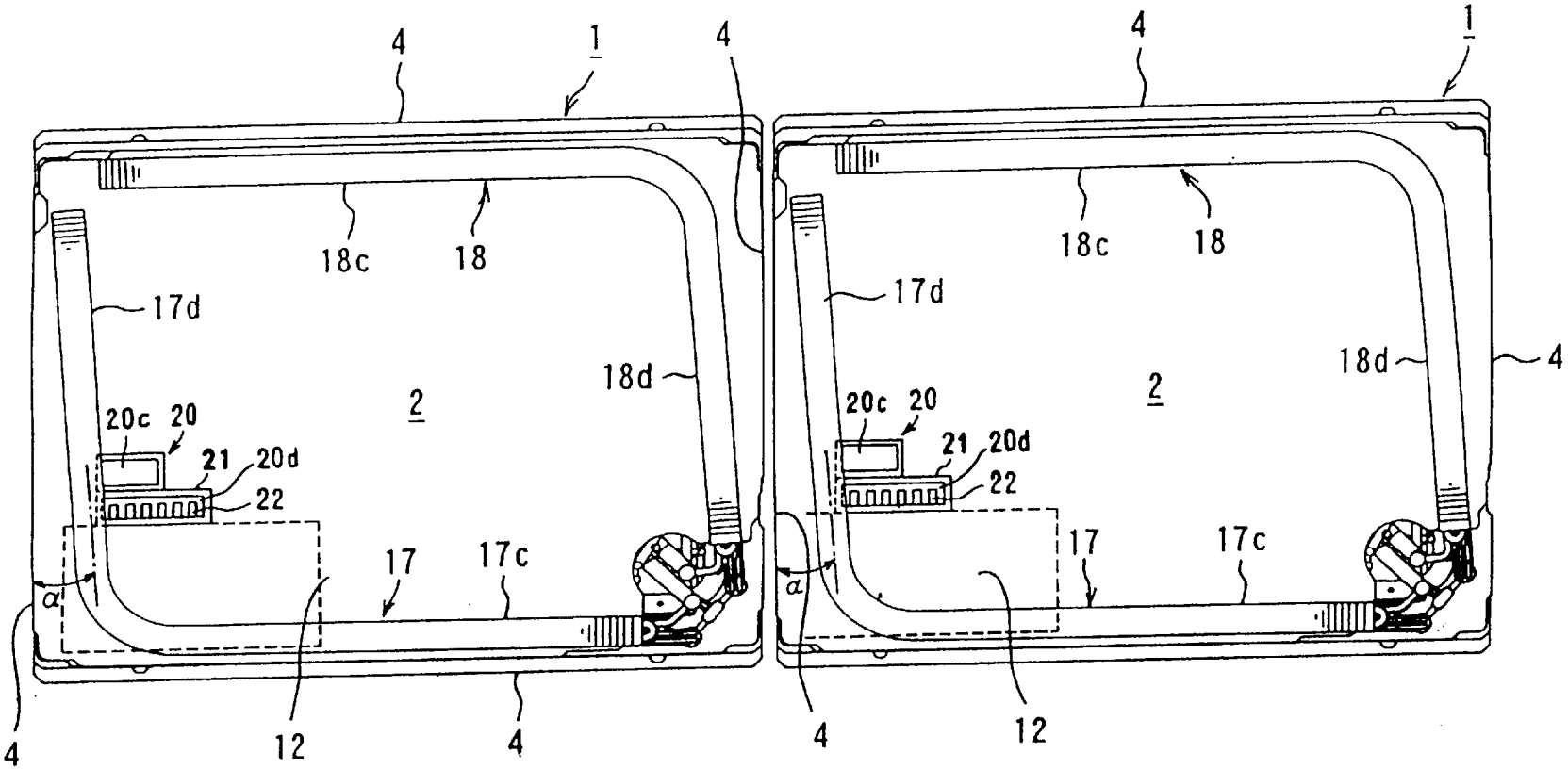
FIG. 5 is an illustration of a plurality of such outdoor units of FIG. 4 which are arranged transversely close to each other.

FIG. 5 is a partially brief plan view showing a case in which a plurality of outdoor units 1, for example, two units, are installed transversely in parallel to each other in a close arrangement.

As shown in FIG. 5, when the adjacent two outdoor units 1, 1 are disposed close to each other so that the inclined opposite sides 18*d* and 17*d* of the heat exchangers 18 and 17 are closely opposed to each other through the side panels 4, and the suction ports 4*a*, 4*a* of these side panels 4, 4 are also opposed. However, the inclined opposite sides 18*d* and 17*d* of both of the heat exchangers 18 and 17 of both of the outdoor units 1, 1 are opposed to the suction ports 4*a* of the other side panels 4 (upper and lower panels shown in FIG. 5) respectively at one side with respect to the transverse direction shown in FIG. 5. Moreover, the suction space of the clearance between the inner surface of each of the side panels 4, 4 of both the outdoor units 1, 1 and each of the opposite sides 17*d* and 18*d* of both the heat exchangers 17 and 18 is expanded by the location of the inclined opposite sides 17*d* and 18*d*, and an decrease in the air suction area of each of the heat exchanger chambers 2 of both of the outdoor units 1, 1 can be suppressed. Therefore, the introduction quantity of the atmospheric air through the air suction ports 4*a* into the heat exchanger chambers 2 can be well ensured.

Therefore, even in the case where a plurality of such outdoor units 1, 1 are disposed and installed, the outdoor units can be installed while maintaining the high heat exchanging ability and function, thus, making it possible to ensure sufficient use of installation position and space. In FIG. 5, even in the case where the left and right outdoor units 1, 1 transversely disposed are replaced so as to be disposed in parallel, substantially the similar effects or functions may be achieved according to the present invention.

Hereunder, the present invention will be further described in relation to its specific drain arrangement or structure with reference to previous FIGS. 1–3 and FIGS. 6–8.

Figure 6:
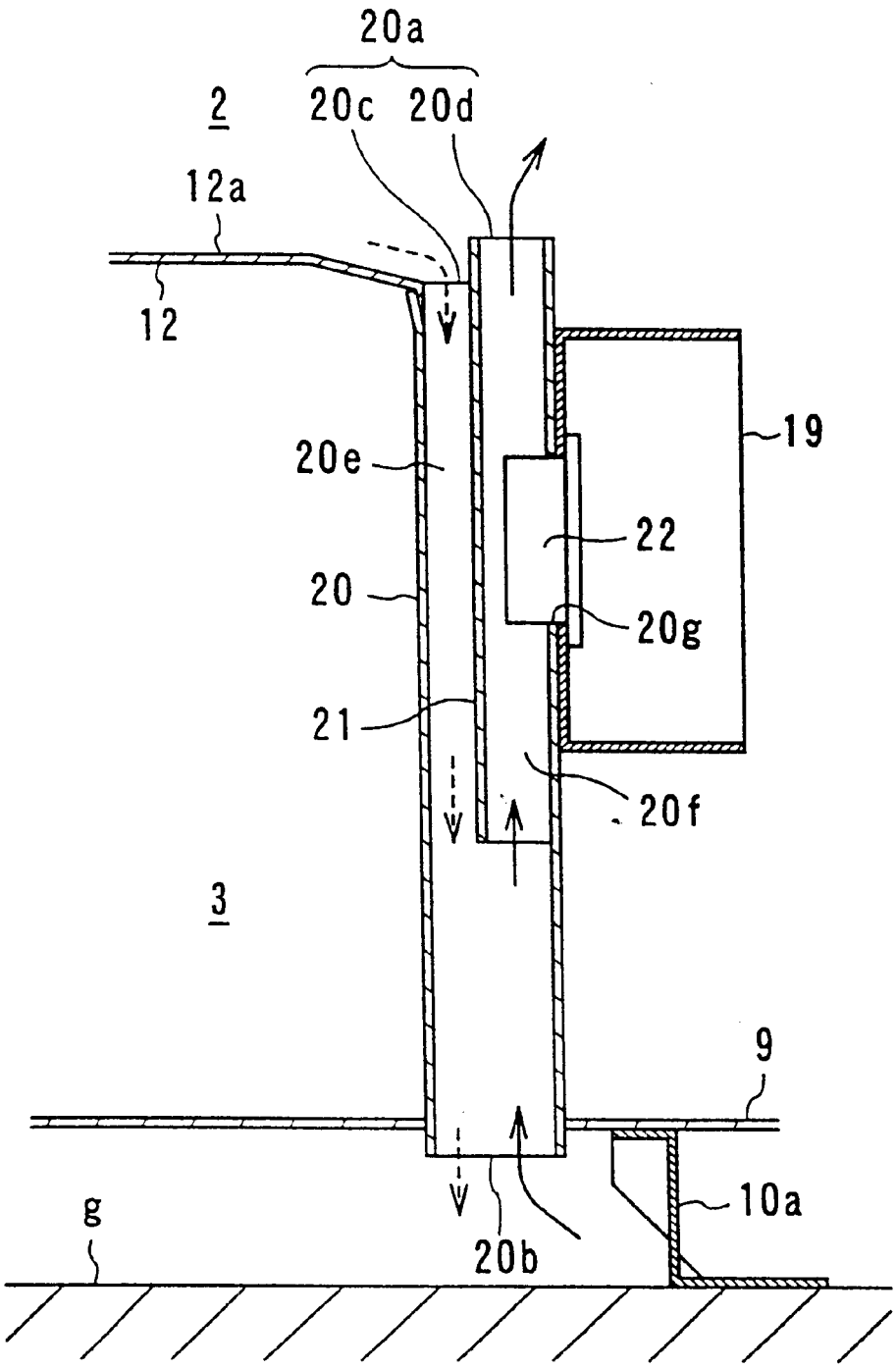
FIG. 6 is an elevational section showing a duct unit section of an outdoor unit of an air conditioner according to another embodiment of the present invention.

With reference to FIGS. 2, 3 and 6, the duct 20 is arranged so as to penetrate the machine chamber 3 in the vertical direction in the vicinity of the inside surface of the electrical part box 19 disposed at a front side portion facing outside of the outdoor unit 1. An upper portion of the duct 20 penetrates the partition plate 12, by a predetermined length in the thickness direction thereof, which will be mentioned herein as drain pan or drain plate 12 as referred to hereinbefore, and the upper end portion thereof is opened as an upper end opening 20*a*, and a lower portion thereof penetrates the bottom plate 9 of the machine chamber 3 and is opened as a lower end opening 20*b* at a position slightly above a mounting base 30 of the outdoor unit 1 as shown in FIG. 6.

In addition, with reference to FIG. 6, in the duct 20, the upper end opening 20*a* is divided into two sections in the transverse direction by a flat partition wall 21, i.e. into a drain discharge port or opening 20*c* and an exhaust air port or opening 20*d*. This partition wall 21 extends in the axial direction in the duct 20 to an intermediate section lower than the electrical part 19, whereby the interior space of the duct 20 is partitioned into a drain discharge passage 20*e* that communicates with the drain discharge opening 20*c* and a ventilation passage 20*f* for cooling the heat sink cooling.

Figure 7:
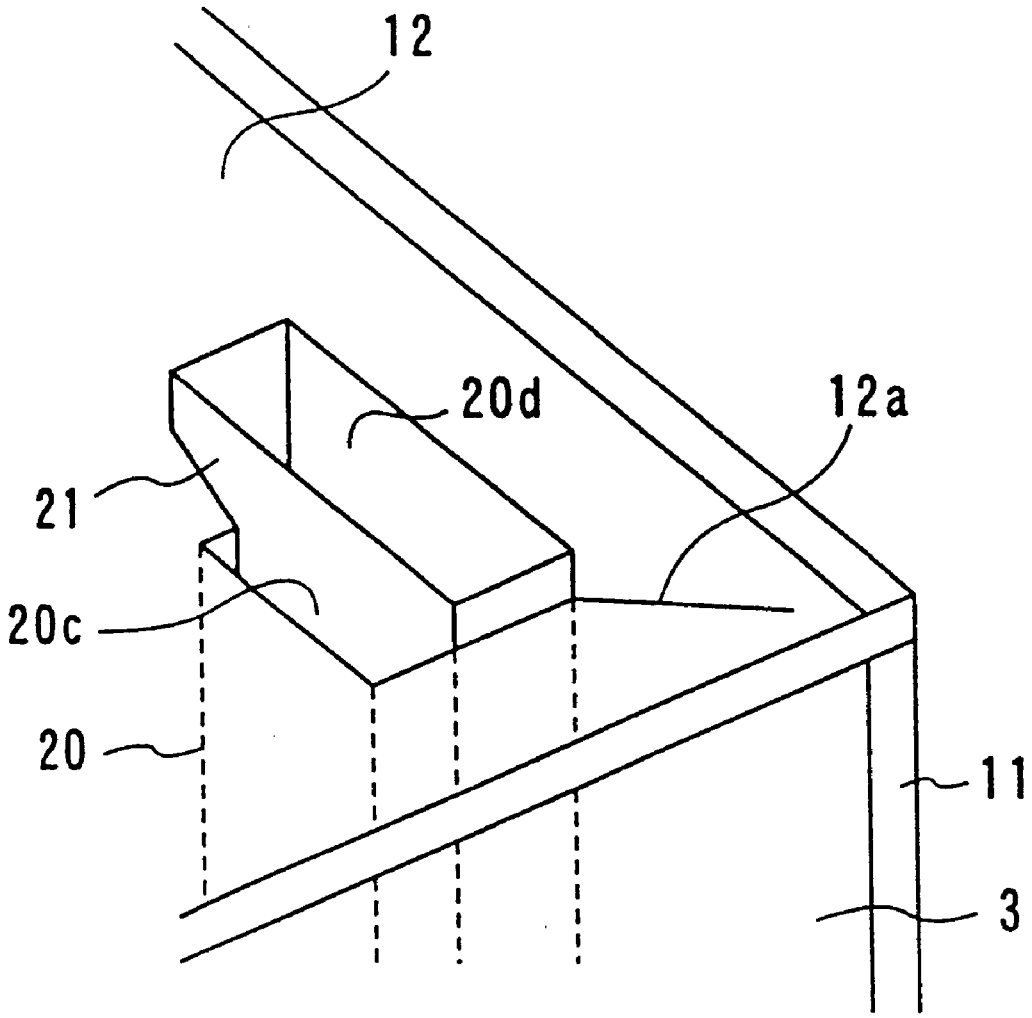
FIG. 7 is an illustrated perspective view of a portion of the outdoor unit of the embodiment of FIG. 6.
Figure 8:
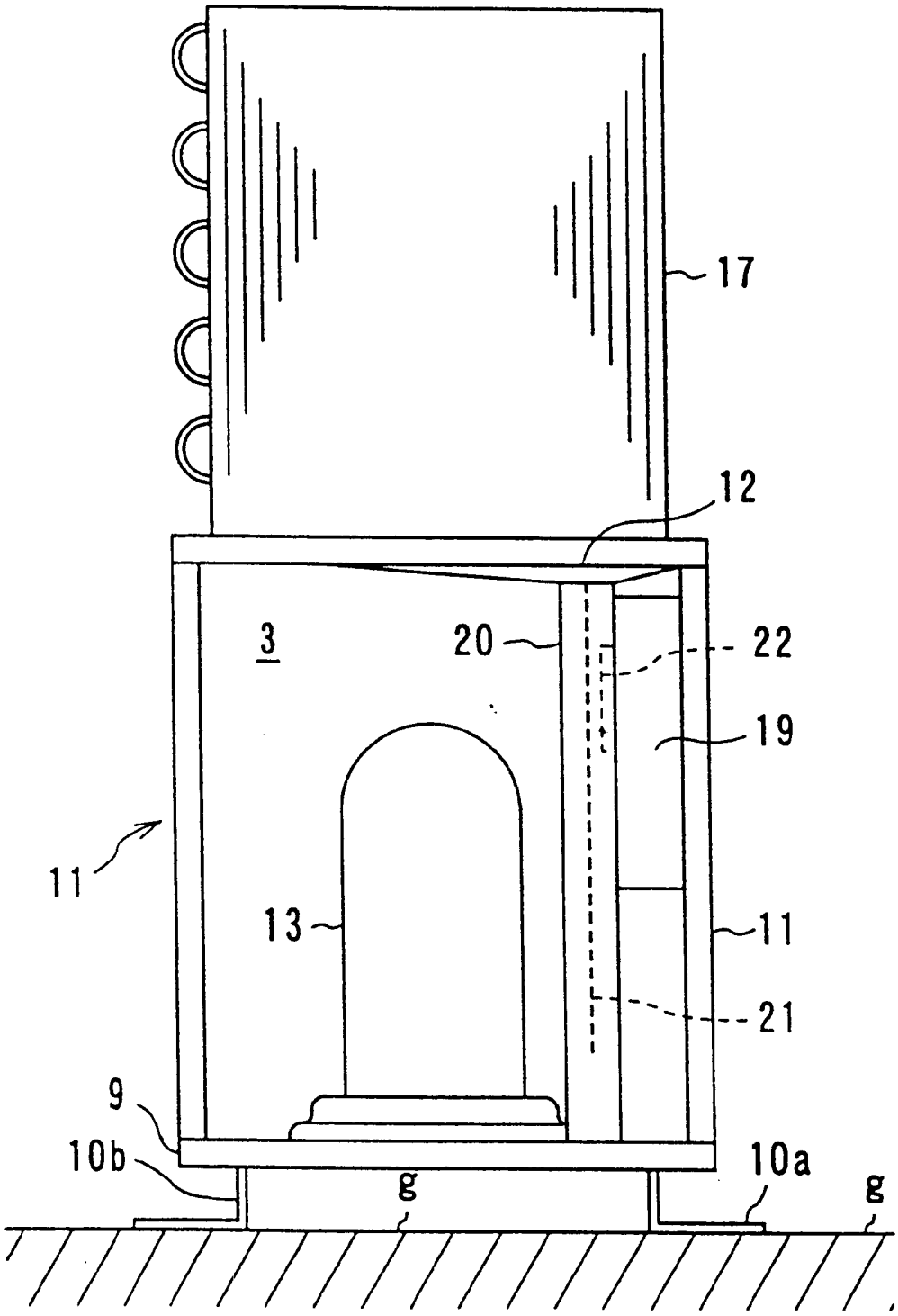
FIG. 8 is a side view of FIG. 2.

As shown in FIGS. 6 and 7, the drain discharge port opening 20*c* is formed by cutting only the upper end portion of the transverse L-shaped side wall section at one side thereof so as to provide the same height as that of the upper surface 12*a* of the drain pan or plate 12, whereas the ventilation opening 20*d*, which is not cut, is formed to be higher than the upper surface 12*a* of the drain pan 12 by a predetermined height. Further, the upper surface 12*a* of the drain pan 12 is inclined downward towards the drain discharge opening 20*c* so as to easily collect a drain (water) to thereby improve the draining efficiency.

As shown in FIGS. 6 and 7, a through hole 20*g* for inserting a heat sink 22 fixed to the electrical part box 19 is punched tn the outside wall of the duct 20 on the side of the ventilation passage 20*f* for cooling the heat sink 22. The heat sink 22 is inserted from the electrical part box 19 to the duct 20 through this hole 20*g*, so that the heat sink 22 is exposed to the ventilation passage 20*f* for cooling the same in the duct 20.

According to the structure and arrangement of the outdoor unit 1 of the present invention described above, when the air conditioner having, for example, a heat pump structure is switched, in operation mode, from a warming operation mode to a defrosting operation mode, the frost deposited to the outer surface of the heat exchangers 17 and 18 is defrosted by the hot gas-like coolant medium that passes through the inside of the heat exchangers 17 and 18 to thereby form a drain water. Such drain water is received by the upper surface (internal bottom face) 12*a* of the drain pan 12 and collected through the drain discharge opening 20*c* of the duct 20 because of the inclination of the upper surface 12*a*. As indicated by the dash-line arrow shown in FIG. 6, water is discharged through the lower end opening 20*b* onto the installation base 30 downward of the bottom plate 9 of the machine chamber 3 through the drain discharge passage 20*e* of the duct 20.

Moreover, the duct 20 is housed in the machine chamber 3 and is not fully exposed to the outside of each of the side panels 4 covering the heat exchanger chamber 2 and the machine chamber 3. Thus, the appearance of the outdoor unit 1 can be improved without strangeness.

In addition, the lower end of the partition wall 21 of the duct 20 terminates at a position higher than the lower end opening 20*b* thereof by a predetermined height. Thus, the drain water is frosted by its height and an ice piece grows, and accordingly, there is much time till the ice reaches and closes the lower end opening end 20*b* of the duct 20. For this reason, the duct 20 can be used as a drain discharge passage during the warming operation of the air conditioner for a long period.

Furthermore, the interior space of the duct 20 is partitioned, by the partition wall section 21, into the drain discharge passage 20*e* and the ventilation passage 20*f* for cooling the heat sink, extending along the axial direction. In addition, the ventilation opening 20*d* that communicates with the ventilation passage 20*f* is positioned to a portion higher than that of a drain discharge opening 20*c* by a predetermined height. Thus, the drain water dropped on the drain pan 12 is prevented from invading inside the ventilation passage 20*f* through the ventilation opening 20*d*, adhering to the heat sink 22 and lowering the electrical insulation.

On the other hand, in a case where the air conditioner is operated in a cooling mode, no drain is produced at the heat exchangers 17 and 18 of the outdoor unit 1. However, by rotating the exterior fan 8, as shown in FIG. 6, the air in a space lower than the bottom plate 9 of the machine chamber 3 is sucked from the lower surface opening 20*b* of the duct 20 to the inside portion thereof as indicated by the solid-line arrow. The ventilation passage 20*f* in the duct 20 is ventilated and the heat sink 22 is cooled. Moreover, the air is sucked into the heat exchanger chamber 2, and then, is exhausted through the blowout opening 6 to the outside. Therefore, the heat sink 22 can be fully cooled.

INDUSTRIAL APPLICABILITY

According to the outdoor unit of an air conditioner of the present invention, the outdoor unit can be installed in a portion having relatively small space and a plurality of outdoor units can be assembled with maintaining the high heat exchanging ability and without damaging air sucking function even if they are closely arranged. Furthermore, the present invention provides the outdoor unit of an air conditioner having an improved duct unit for discharging drain. The duct unit is accommodated in the outdoor unit case, so that the outer appearance thereof cannot be damaged, and hence, the outdoor unit can be installed to a portion at which it is necessary to effectively utilize the location or installation space.

What is claimed is:

1. An outdoor unit of an air conditioner, comprising:

a unit case having a rectangular shape in section and composed of side panels in which a machine chamber and a heat exchanger chamber are defined so as to be vertically aligned in an installed state, said heat exchanger chamber being disposed above said machine chamber and being separated therefrom by means of a partition plate, said side panels surrounding the heat exchanger chamber being formed with air suction ports; and a heat exchanger unit having four side wall sections at least opposing two of which are inclined inward by a predetermined angle with respect to inner surfaces of the side panels to which the air suction ports are formed.

2. An outdoor unit of an air conditioner according to claim 1, wherein said at least two side wall sections of the heat exchanger unit are arranged in substantially parallel to each other.

3. An outdoor unit of an air conditioner according to claim 1, wherein said heat exchanger unit comprises a pair of heat exchangers each having an L-shape in a plan view providing an obtuse angle so that the respective sides of the L-shaped heat exchangers are arranged to be opposed to the air suction ports, respectively, and to provide substantially a parallelogram shape in a plan view.

4. An outdoor unit of an air conditioner according to claim 1, wherein electrical elements are arranged in the machine chamber.

5. An outdoor unit of an air conditioner according to claim 1, wherein said partition plate sectioning, in a vertical direction, the heat exchanger chamber and the machine chamber has a dish-shape acting as drain pan to which a drain duct is formed.

6. An outdoor unit of an air conditioner, comprising:

a unit case having a rectangular shape in section and composed of side panels in which a machine chamber and a heat exchanger chamber are defined so as to be vertically aligned in an installed state, said heat exchanger chamber being disposed above said machine chamber and said side panels surrounding the heat exchanger chamber being formed with air suction ports;

a heat exchanger unit having four side wall sections opposing to inner surfaces of the side panels to which the air suction ports are formed;

an electrical element disposed on a bottom plate of the machine chamber;

a drain pan formed as a partition plate sectioning said heat exchanger chamber and said machine chamber in a vertical direction; and a duct unit having upper and lower openings opened to an upper surface of the drain pan and opened to a lower surface of the bottom plate of the machine chamber, wherein the upper opening of said duct unit is divided into a plurality of ports by a partition plate so that one opening port is in a level substantially the same as the upper surface of the drain pan and another opening port is in a level higher than the upper surface thereof.

7. An outdoor unit of an air conditioner according to claim 6, wherein said electrical element is disposed in the machine chamber at a front side portion of the unit case facing outside thereof.

8. An outdoor unit of an air conditioner according to claim 7, wherein said electrical element includes a heat sink.

9. An outdoor unit of an air conditioner according to claim 8, wherein said duct unit is provided with an air passage communicated with the other opening port disposed in the level higher than the upper surface of the drain pan and said air passage is formed with an opening through which the heat sink is exposed.

10. An outdoor unit of an air conditioner according to claim 6, wherein said partition wall has a lower end portion ended at a portion upper than the lower end opening of the duct unit.

11. An outdoor unit according of an air conditioner comprising:

a unit case having a rectangular shape in section and composed of side panels in which a machine chamber and a heat exchanger chamber are defined so as to be vertically aligned in an installed state, said heat exchanger chamber being disposed above said machine chamber and said side panels surrounding the heat exchanger chamber being formed with air suction ports;

a heat exchanger unit having four side wall sections opposing to inner surfaces of the side panels to which the air suction ports are formed;

an electrical element disposed on a bottom plate of the machine chamber; a drain pan formed as a partition plate sectioning said heat exchanger chamber and said machine chamber in a vertical direction; and a duct unit having upper and lower openings opened to an upper surface of the drain pan and opened to a lower surface of the bottom plate of the machine chamber, wherein said heat exchanger unit has four side wall sections at least opposing two of which are inclined inward by a predetermined angle with respect to inner surfaces of the side panels to which the air suction ports are formed.

* * * * *